US005234575A

United States Patent [19]

Haag et al.

[11] Patent Number: 5,234,575

[45] Date of Patent: Aug. 10, 1993

[54] CATALYTIC CRACKING PROCESS UTILIZING AN ISO-OLEFIN ENHANCER CATALYST ADDITIVE

[75] Inventors: Werner O. Haag; Mohsen N. Harandi, both of Lawrenceville; Hartley Owen, Belle Mead, all of N.J.

[73] Assignee: Mobil Oil Corporation, Fairfax, Va.

[21] Appl. No.: 738,370

[22] Filed: Jul. 31, 1991

[51] Int. Cl.[5] ..... C10G 57/00

[52] U.S. Cl. ..... 208/70; 208/49; 208/120; 208/134

[58] Field of Search ..... 208/60, 70, 67, 69, 208/120, 120 MC, 134

[56] References Cited

U.S. PATENT DOCUMENTS

| | | | |
|---|---|---|---|
| 4,749,819 | 6/1988 | Hamilton, Jr. | 585/329 |
| 4,753,720 | 6/1988 | Morrison | 208/135 |
| 4,892,643 | 1/1990 | Herbst et al. | 208/70 |
| 4,969,987 | 11/1990 | Le et al. | 208/67 |

*Primary Examiner*—Theodore Morris
*Assistant Examiner*—Walter D. Griffin
*Attorney, Agent, or Firm*—Alexander J. McKillop; Malcolm D. Keen; Marina V. Schneller

[57] ABSTRACT

The invention relates to improving the selectivity of the production of isobutylene or 2-methylpropene during fluid catalytic cracking of heavy $C_9+$ aromatic containing feeds including resids and/or gas oils by employing two catalyst components, one of which comprises ZSM-23, ZSM-22, ZSM-35 or similarly structured catalysts and the other catalyst component being effective under the fluid catalytic cracking conditions to produce high octane gasoline.

16 Claims, 2 Drawing Sheets

CATALYTIC CRACKING PROCESS UTILIZING AN ISO-OLEFIN ENHANCER CATALYST ADDITIVE

BACKGROUND OF THE INVENTION

The invention relates to a fluid catalytic cracking process for upgrading heavy petroleum stocks containing high molecular weight aromatics, such as resids and gas oils, to produce light and/or heavy distillate, while maintaining a high selectity of the process for isobutylene production in the $C_3$–$C_4$ off gas production, during catalytic cracking operations.

The four $C_4$ mono-olefins, 1-butene, cis-2-butene, trans-2-butene and 2-methylpropene are collectively called butylenes. The term isobutylene is by established usage interchangeable with the nomenclature 2-methylpropene, while the other three isomers are n-butenes. Often they are treated collectively because the four mono-olefins are obtained as mixtures, from natural gas and from petroleum refinery processes.

Isobutylene is a desirable reactant for the production of alkylate, an oligomer of petroleum refinery $C_3$–$C_4$ off gases, which includes high octane gasoline components, and for the production of methyl-t-butyl ether, when isobutylene is reacted with methanol. A conventional process for separation of isobutylene from the other three components involves sulfuric acid extraction or selective adsorption, as the isomers cannot be separated by simple extraction. Acid extraction is cumbersome and includes as an undesirable aspect the oligomerization of the components themselves.

In known and conventional fluidized catalytic cracking processes, a relatively heavy hydrocarbon feedstock, e.g., a gas oil, admixed with a suitable cracking catalyst, e.g., a large pore crystalline silicate zeolite such as zeolite Y, to provide a fluidized suspension is cracked in an elongated reactor, or riser, at elevated temperature to provide a mixture of lighter hydrocarbon products. The gasiform reaction products and spent catalyst are discharged from the riser into a separator, e.g., a cyclone unit, located within the upper section of an enclosed stripping vessel, or stripper, with the reaction products being conveyed to a product recovery zone and the spent catalyst entering a dense catalyst bed within the lower section of the stripper. In order to remove entrained hydrocarbon product from the spent catalyst prior to conveying the latter to a catalyst regenerator unit, an inert stripping gas, e.g., steam, is passed through the catalyst where it desorbs such hydrocarbons conveying them to the product recovery zone. The fluidized catalyst is continuously circulated between the riser and the regenerator and serves to transfer heat from the latter to the former thereby supplying the thermal needs of the cracking reaction which is endothermic.

Particular examples of such catalytic cracking processes are disclosed in U.S. Pat. Nos. 3,617,497, 3,894,932, 4,309,279 and 4,368,114 (single risers) and U.S. Pat. Nos. 3,748,251, 3,849,291, 3,894,931, 3,894,933, 3,894,934, 3,894,935, 3,926,778, 3,928,172, 3,974,062 and 4,116,814 (multiple risers).

U.S. Pat. No. 3,894,932 describes a single riser fluid catalytic cracking operation in which a gas oil and a $C_{3-4}$-rich gaseous material is converted to aromatics and isobutane in the presence of a faujasite-type zeolite, e.g., zeolite Y.

U.S. Pat. No. 3,894,935 describes a dual riser fluid catalytic cracking process in which a gas oil is catalytically cracked in a first riser in the presence of a faujasite-type zeolite such as zeolite Y to provide gasoline boiling-range material and a $C_{3-4}$-rich hydrocarbon fraction including isobutylene which is converted in a second riser in the presence of hot regenerated catalyst or catalyst cascaded thereto from the first riser to provide aromatics, alkyl aromatics and low boiling gaseous material.

Several of the processes referred to above employ a mixed catalyst system with each component of the system possessing different catalytic properties and functions. For example, in the dual riser hydrocarbon conversion process described in U.S. Pat. No. 3,894,934, a heavy hydrocarbon first feed, e.g., a gas oil, is cracked principally as a result of contact with a large pore crystalline silicate zeolite cracking catalyst, e.g., zeolite Y, to provide lighter products. Spent catalyst is separated from the product stream and enters the dense fluid catalyst bed in the lower section of the stripping vessel. A $C_{3-4}$ olefin-rich second feed, meanwhile, undergoes conversion to cyclic and/or alkylaromatic hydrocarbons in a second riser, principally as a result of contact with a shape selective medium pore crystalline silicate zeolite, e.g., zeolite ZSM-5. Spent catalyst recovered from the product stream of the second riser similarly enters the dense catalyst bed within the stripper vessel. U.S. Pat. No. 3,894,934 also features the optional introduction of a $C_3$-containing hydrocarbon third feed along with an aromatic-rich charge into the dense fluid bed of spent catalyst above the level of introduction of the stripping gas to promote the formation of alkyl aromatics therein. As desired, the third feed may be light gases obtained from a fluid cracking light ends recovery unit, virgin straight run naphtha, catalytically cracked naphtha, thermal naphtha, natural gas constituents, natural gasoline, reformates, a gas oil, or a residual oil of high coke-producing characteristics.

In this and other fluidized catalytic cracking operations employing mixtures of large and medium pore size crystalline silicate zeolite catalysts where catalyst separated from the product effluent is conveyed to a stripper and from there to a catalyst regenerating zone, regardless of the nature of the catalyst introduction at start-up, once steady-state operation has been achieved, the two types of catalyst will become fairly uniformly mixed and will circulate throughout the system at or about the same rate.

SUMMARY OF THE INVENTION

It is an object of the invention to provide a catalytic cracking process for the conversion of a hydrocarbon charge stock to lighter products, e.g., gasoline, distillate and light olefins, employing a mixed catalyst system.

It is an object of the invention to produce a mixture of the $C_4$ mono-olefins and to convert the n-butene(s) therein to isobutylene. Accordingly, an object of the process is to produce isobutylene with high selectivity.

The process of the invention comprises catalytic conversion of heavy aromatic containing feed stocks, such as resids and gas oils, to gasoline, light distillate, heavy distillate and low molecular weight olefins and particularly to a $C_4$ olefin mixture, including 1-butene, cis-2-butene, trans-2-butene and 2-methylpropene, in the gaseous phase, and contact of that mixture with a catalyst which will convert at least one of the members selected from the group consisting of 1-butene, cis-2-butene, and trans-2-butene to isobutylene product, free of oligomers of any of the $C_4$ monoolefins. Another object of this invention is to increase i-$C_5$=production in the FCC unit by increasing isomerization of n—$C_5$=to i—$C_5$=. The conditions include a temperature of from about 800° to about 1150° F., a catalyst to feed ratio of from about 3:1 to about 10:1, catalyst contact time of 0.5 to about 10 seconds, a ZSM-23, ZSM-22 or ZSM-35 level of 0.01 to 1.0 weight percent of the total catalyst inventory.

It is a particular object of the present invention to provide a catalytic cracking process featuring in cooperative association at least one riser reactor, at least one stripping unit and at least one catalyst regenerator and employing a mixed catalyst system comprising, as a first catalyst component, an amorphous cracking catalyst and/or a large pore crystalline cracking catalyst which requires relatively frequent regeneration and, as a second catalyst component, at least one shape selective medium pore crystalline silicate zeolite catalyst. The latter requires regeneration less frequently than the first catalyst component. Physical characteristic(s) of particles of first catalyst component can differ sufficiently from physical characteristic(s) of particles of second catalyst component so as to permit their separation for example within the stripping zone and subsequent transfer of the second catalyst component to a separate reactivation zone; the overall result of such differences in physical properties is a reduction in the rate of circulation of the second catalyst component through the regeneration zone and a capability for efficiently and selectively reactivating the second catalyst component.

In keeping with the foregoing objects, there is provided a catalytic cracking operation featuring at least one riser reactor, at least one stripping unit and at least one regenerator, which comprises:

a) cracking a resid and/or gas oil feed in the lower section of the riser in the presence of the first catalyst component to produce gasoline, distillate and $C_3$–$C_4$ olefins and b) contacting the step a) reaction product containing $C_4$–$C_5$ olefins therein with a second catalyst component, the second catalyst component comprising at least one shape selective medium pore crystalline silicate zeolite, which must include ZSM-23, ZSM-35, or ZSM-22.

DETAILED DESCRIPTION OF THE INVENTION

Figure 1:
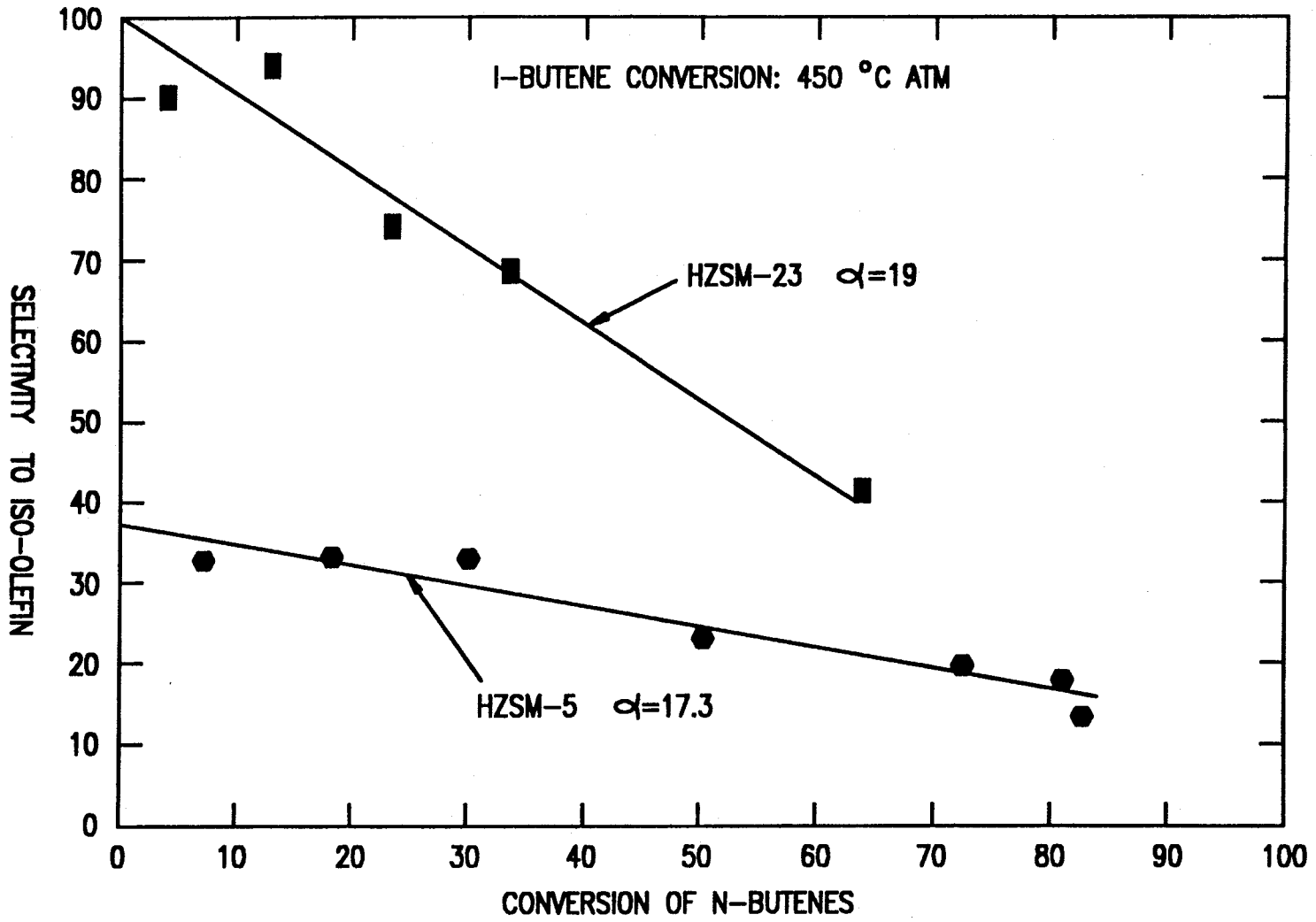
FIG. 1 is a graph of the plot of the selectivity of the production to iso-olefin vs. conversion of n-butenes. The drawing illustrates the effect of catalyst on isobutene selectivity, of 1-butene conversion at 450° C. and one atmosphere over ZSM-23 and ZSM-5.

Suitable charge stocks for cracking in the riser comprise the heavy hydrocarbons generally and, in particular, $C_9$+ petroleum fractions having an initial boiling point range of at least 400° F., a 50% point range of at least 500° F. and an end point range of at least 700° F. Such hydrocarbon fractions include gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. The distillation of higher boiling petroleum fractions above about 750° F. must be carried out under vacuum in order to avoid thermal cracking.

Conventional cracking catalyst components are generally amorphous silica-alumina and crystalline silica-alumina. Other materials said to be useful as cracking catalysts are the crystalline silicoaluminophosphates of U.S. Pat. No. 4,440,871 and the crystalline metal aluminophosphates of U.S. Pat. No. 4,567,029.

However, the major conventional cracking catalysts presently in use generally comprise a large pore crystalline silicate zeolite, generally in a suitable matrix component which may or may not itself possess catalytic activity. These zeolites typically possess an average crystallographic pore dimension of about 7.0 Angstroms and above for their major pore opening. Representative crystalline silicate zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), merely to name a few, as well as naturally occurring zeolites such as chabazite, faujasite, mordenite, and the like. Also useful are the silicon- substituted zeolites described in U.S. Pat. No. 4,503,023. Zeolite Beta is yet another large pore crystalline silicate which can constitute a component of the mixed catalyst system utilized herein.

It is, of course, within the scope of this invention to employ two or more of the foregoing amorphous and/or large pore crystalline cracking catalysts as the first catalyst component of the mixed catalyst system. Preferred crystalline zeolite components of the mixed catalyst system herein include the natural zeolites mordenite and faujasite and the synthetic zeolites X and Y with particular preference being accorded zeolites Y, REY, USY and RE-USY and mixtures thereof.

The second catalyst component must include ZSM-23, ZSM-22 or ZSM-35, and may optionally include an additional shape selective medium pore crystalline silicate zeolite catalyst selected from the group consisting of ZSM-5, ZSM-11, ZSM-12, ZSM-38, ZSM-48 and other similar materials. U.S. Pat. No. 3,702,886 describing and claiming ZSM-5 is incorporated herein by reference. Also, U.S. Reissue Pat. No. 29,948 describing and claiming a crystalline material with an X-ray diffraction pattern of ZSM-5 is incorporated herein by reference as is U.S. Pat. No. 4,061,724 describing a high silica ZSM-5 referred to as "silicalite" therein.

ZSM-11 is more particularly described in U.S. Pat. No. 3,709,979, the entire contents of which are incorporated herein by reference.

ZSM-12, is more particularly described in U.S. Pat. No. 3,832,449, the entire contents of which are incorporated herein by reference.

ZSM-22 is more particularly described in U.S. Pat. No. 4,902,406, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

ZSM-48 is more particularly described in U.S. Pat. No. 4,375,573, the entire contents of which are incorporated herein by reference.

In general, the aluminosilicate zeolites are effectively employed herein. However, zeolites in which some other framework element which is present in partial or total substitution of aluminum can be advantageous. For example, such catalysts may provide a higher conversion of feed to aromatic components, the latter tending to increase the octane, and therefore the quality, of the gasoline produced in the process. Illustrative of elements which can be substituted for part or all of the framework aluminum are boron, gallium, zirconium, titanium and any other trivalent metal which is heavier than aluminum. Specific examples of such catalysts include ZSM-5 containing boron, gallium, zirconium and/or titanium. In lieu of, or in addition to, being incorporated into the zeolite framework, these and other catalytically active elements can also be deposited upon the zeolite by any suitable procedure, e.g., impregnation.

Optionally, particles of the two catalyst components can be prepared so that separation in the stripping unit can be accomplished in several ways. For example, the two components can be provided in such different average particle sizes or densities that they can be readily sorted for example within a stripping unit possessing suitable sieving means, an arrangement more particularly described in connection with the single riser fluidized catalytic cracking unit illustrated in FIG. 2, infra.

Figure 2:
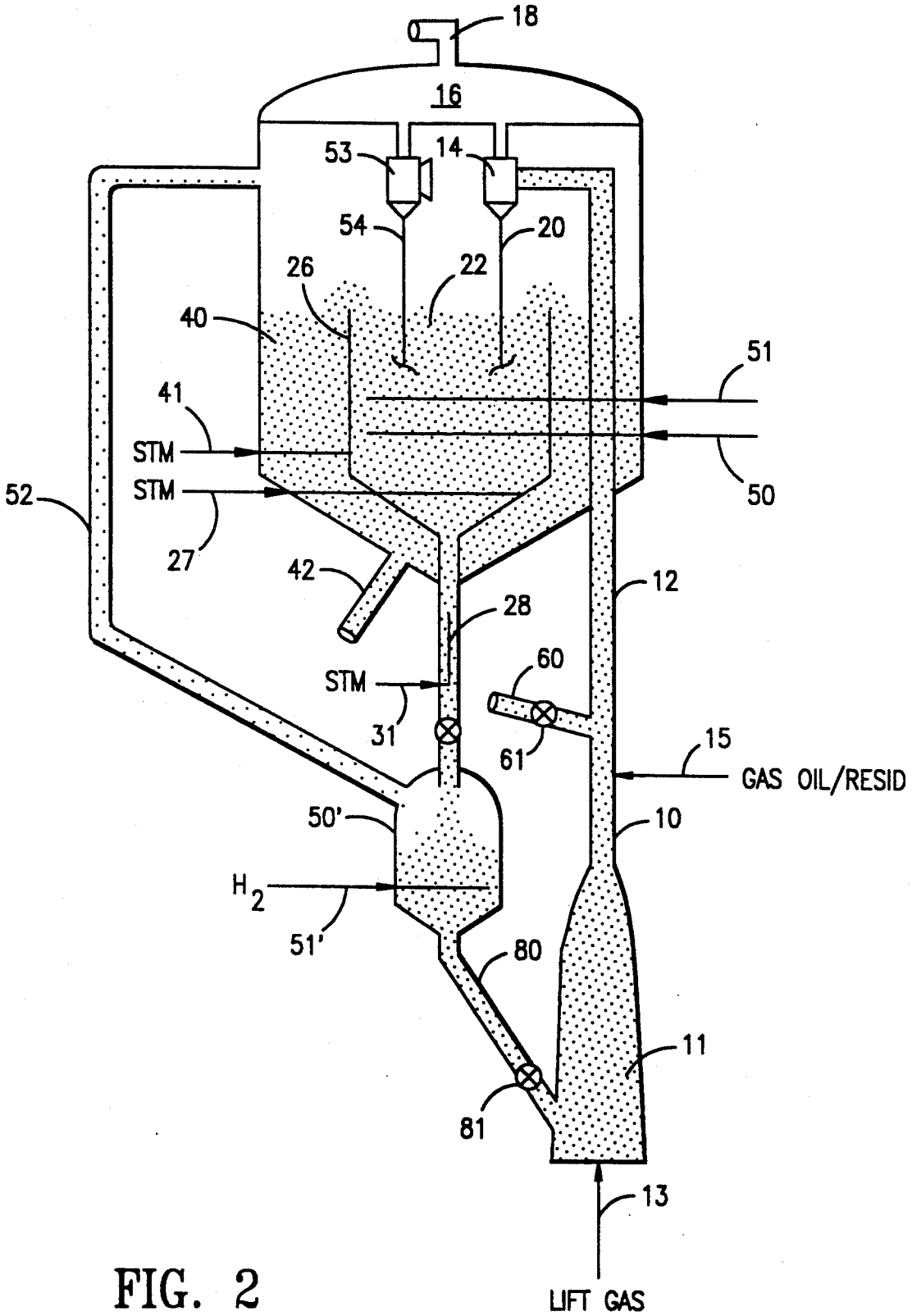
FIG. 2 is a schematic illustration of a fluid catalytic cracking unit (FCC).

Separation within the stripping zone can also be achieved by classifying the first and second catalyst components according to their average particle densities which can be made to be significantly different in various ways including by appropriate selection of the matrix components with which they are composited as more fully explained below. In general, smaller, less dense catalyst particles will tend on the average to define an upper phase within the stripper floating upon larger, more dense catalyst particles which, conversely, will tend on the average to define a lower phase within the stripper.

Where separation of catalyst particles is based largely on differences in density, several techniques can be used to affect their separation including the use of a lift medium, e.g., steam to separate less dense catalyst particles from more dense catalyst particles and convey the former to a separate region of the stripper, such being described more fully, infra, in connection with the stripping unit embodiments shown in FIG. 2.

It is, of course, within the scope of this invention to affect separation of catalyst particles either before or after carrying out a stripping operation thereon.

Once their separation into different regions of the stripper has been accomplished, the particles of second catalyst component, are conveyed to a reactivation zone supplied with a suitable reactivating medium, e.g., hydrogen or hydrogen-rich gas, where reactivation of the catalyst occurs under known and conventional conditions, e.g., a temperature of from about 800° F. to about 1500° F. or even higher and preferably at from about 1000° F. to about 1400° F. Preferably, hydrogen is introduced into the reactivation zone at a temperature which is somewhat higher than that of the resident catalyst so as to improve the efficiency of any stripping taking place therein. This can be readily accomplished by preheating the hydrogen by exchange with hot regenerated catalyst or flue gas from the regenerator. The gaseous effluent of the reactivation operation can be combined with the other product gases. The particles of second catalyst component may or may not have been stripped at the time of their transfer to the reactivation zone. In the case of the latter, the reactivation operation also serves to desorb hydrocarbonaceous material entrained by the catalyst particles.

The characterizing physical properties of the first and second catalyst components are so selected that they each will exhibit different settling rates, designated $R_1$ and $R_2$ respectively, which permit the catalyst particles having the greater settling rate, to remain on average within the lower region of the riser longer than the catalyst particles having the lower settling rate, e.g., longer than the particles of first catalyst component. Residency time of catalyst particles in a riser is primarily dependent on two factors: the linear velocity of the fluid stream within the riser which tends to carry the entire catalyst bed/conversion products/unconverted feed up and out of the riser into the separator unit and the opposing force of gravity which tends to keep the slower moving catalyst particles within the riser. Ordinarily, in a mixed catalyst system, both catalyst components will circulate through the system at about the same rate. As previously pointed out, this has proven disadvantageous to the efficiency of the system since the medium pore zeolite catalyst or other catalyst component which does not require as frequent regeneration as the large pore zeolite cracking catalyst will be needlessly subjected to the catalyst-degrading conditions of the regenerator with the result that its useful catalytic life will be shortened. However, in accordance with this invention, it is possible to retain the less coke deactivated zeolite shape selective medium pore crystalline silicate zeolite catalyst within the riser, even to the point where, because of a balance between the upward velocity of this catalyst component and its settling rate, it can be made to remain more or less stationary within the lower region of the riser defining a zone of concentration therein. To bring about this balance or to otherwise prolong the residency time of the catalyst component of the mixed catalyst system within the lower region of the riser, the average density, particle size and/or shape of the catalyst particles can be adjusted in a number of ways as to provide the desired settling characteristics. As a general guide, as the average particle size of the catalyst increases and/or its average particle density increases, the residency time of the catalyst will increase.

Assuming, for example, this differential in $R_1$ and $R_2$ is accomplished by making the particles of the second catalyst component initially larger and of greater density than the particles of first catalyst component and perhaps even more irregular in shape than the latter, gradual attrition of the larger particles (through particle collision) will progressively reduce their capability for prolonged residency in the riser and as time goes on, increasing quantities of such particles will enter the stripping zone where, however, they can still be readily separated based on their different densities as later more fully explained. This arrangement, i.e., increased residency time in the riser coupled with separation in the stripping zone, maximizes the capability of the catalytic cracking process of this invention for reducing the rate of circulation of the less coke deactivated and/or hydrothermally stable catalyst particles through the regenerator zone.

Among the techniques which can be used for making one catalyst component more dense than the other is compositing each catalyst with a matrix component of substantially different density. Useful matrix components include the following:

| matrix component | particle density (gm/cm$^3$) |
|---|---|
| alumina | 3.9–4.0 |
| silica | 2.2–2.6 |
| magnesia | 3.6 |
| beryllia | 3.0 |
| barium oxide | 5.7 |
| zirconia | 5.6–5.9 |
| titania | 4.3–4.9 |

Combinations of two or more of these and/or other suitable porous matrix components, e.g., silica-alumina, silica-magnesia, silica-thoria, silica-alumina-zirconia, etc., can be employed for a still wider spectrum of density values from which one may select a specific predetermined value as desired.

In general, selection of each matrix component will be such that the catalyst which is to have the lower rate of circulation through the regenerator will be more dense than the catalyst requiring frequent regeneration. For example, in the case of a mixed catalyst system containing medium pore and large pore crystalline silicate zeolites where it is desired to increase the residency time of the medium pore zeolite catalyst in the lower region of the riser, the overall packed density of the medium pore zeolite catalyst particles inclusive of its matrix component can advantageously vary from about 0.6 to about 4.0 gm/cm$^3$, and preferably from about 2.0 to about 3.0 gm/cm$^3$, and the overall packed density of the large pore zeolite catalyst particles inclusive of its matrix component can advantageously vary from about 0.4 to about 1.1 gm/cm$^3$ density, and preferably from about 0.6 to about 1.0 gm/cm$^3$.

Another useful technique for adjusting the density of each catalyst component, again in the case of a mixture of medium and large pore zeolites, is to composite the medium pore zeolite catalyst particles with a material which tends to coke up faster than the particles of large pore zeolite catalyst, such resulting in an increase in the density of the former in situ. Illustrative of such materials is hydrated alumina which in situ forms a transition alumina which has a rapid coking rate. This embodiment possesses several additional advantages. In the coked-up state, the composited medium pore silicate zeolite catalyst is more resistant to attrition which results from collision with other particles in the riser. The individual catalyst particles can sustain more collisions and thus serve as a practical means of adjusting the velocity of the large pore zeolite catalyst particles through the riser (the latter in colliding with the medium pore zeolite particles will, as a result, have reduced velocity). In addition, the coked-up composited medium pore zeolite catalyst particles will tend to accumulate metals present in the feed.

As previously stated, the relative settling rate of each catalyst component can be selected by varying the average particle size of the catalyst particles. This can be readily accomplished at the time of compositing the catalyst particles with various matrix components. As between two catalyst components of significantly different average particle size, the larger will tend to remain within the riser longer than the smaller. When it is desired to increase the residency time of the medium pore zeolite catalyst particles in the first riser over that of the large pore zeolite catalyst component, the average particle size of the former will usually be larger than that of the latter. So, for example, the average particle size of the medium pore zeolite catalyst particles can be made to vary from about 500 microns to about 70,000 microns, and preferably from about 100 to about 25,000 microns while the average particle size of the large pore zeolite catalyst particles can be made to vary from about 20 to about 150 microns, and preferably from about 50 to about 100 microns.

The shape, or geometric configuration, of the catalyst particles also affects their relative settling rates, the more irregular the shape (i.e., the more the shape deviates from a sphere), the longer the residency time of the particles in the riser. Irregular-shaped particles can be simply and readily achieved by crushing the catalyst-matrix extrudate or using an extruded catalyst.

As will be appreciated by those skilled in the art, the settling rate for a particular catalyst component will result from the interaction of each of the three foregoing factors, i.e., density, average particle size and particle shape. The factors can be combined in such a way that they each contribute to the desired result. For example, the particles of the less coke deactivated second catalyst component can simultaneously be made denser, larger and more irregular in shape than the first catalyst particles which require relatively frequent regeneration. However, a differential settling rate can still be provided even if one of the foregoing factors partially offsets another as would be the case where greater density and smaller average particle size coexist in the same catalyst particle. Regardless of how these factors of particle density, size and shape are established for a particular catalyst component, their combined effect will, of course, be such as to result in a significant differential in settling rates of the components comprising the mixed catalyst system of this invention.

The ZSM-23 zeolite, and any other shape selective medium pore crystalline silicate zeolite catalyst can be present in the mixed catalyst system over widely varying levels. The ZSM-23 can comprise 0.01 to 5 weight percent of the total catalyst inventory. The shape selective zeolite other than ZSM-23, ZSM-22 or ZSM-35, can comprise 0.01 to 30 weight percent of the catalyst inventory. Preferably, the ZSM-23 zeolite concentration of the second component can be present at a level as low as about 0.01 to about 1.0 weight percent of the total catalyst inventory.

Fluid catalytic cracking conditions include a temperature within the range of from about 950° to about 1150° F., preferably from about 1000° to about 1100° F. The catalyst to feed ratio is from about 3:1 to about 10:1, preferably from about 4:1 to about 8:1. The catalyst contact time can range from about 0.5 to about 10 seconds, preferably from about 1 to about 5 seconds.

The exact distribution and yield of $C_4$s and $C_5$s will depend on the operating severity of the fluid catalytic cracking conditions. The $C_4$–$C_5$ fraction may be separated from the reactor effluent, which may also be produced, by conventional pressure distillation. However this separation is not essential and is not preferred. In fact, in implementing the invention, it would be preferred to add the ZSM-23 catalyst to the cracker in short time intervals or continuously. The ZSM-23 catalyst can be added to the FCC unit at any location in the riser, transfer line, or reactor cyclones. Presently, it is contemplated that, preferably less than 0.1% of ZSM-23 is added to the cracker catalyst inventory per day.

The $C_4$–$C_5$ containing mixture is contacted with ZSM-23, to increase the isobutylene and isoamylene content of the composition, and to decrease the content of the $C_4$s and $C_5$s other than isobutylene and isoamylene, while maintaining the total amount of $C_4$ and $C_5$ isomers substantially constant, without oligomerization thereof. Accordingly, the product of the ZSM-23 reaction of the invention is substantially free of oligomerization products of the any one of the $C_4$–$C_5$ mono-olefins.

The process of the invention comprises catalytic production of the $C_4$ olefin mixture, including 1-butene, cis-2-butene, trans-2-butene and 2-methylpropene, in the gaseous phase, and contact of that mixture with a catalyst which will convert at least one of the members selected from the group consisting of 1-butene, cis-2-butene, and trans-2-butene to isobutylene product, free of oligomers of any of the $C_4$ monoolefins.

The physical conditions of the vapor phase catalytic isomerization of the n—$C_4$= and n—$C_5$= to the isobutylene and iso-amylene include a temperature within the range of from about 950° to about 1150° F., preferably from about 1000° to about 1100° F. The catalyst to feed ratio is from about 3:1 to about 10:1, preferably from about 4:1 to about 8:1. The catalyst contact time can range from about 0.5 to about 10 seconds, preferably from about 1 to about 5 seconds. Accordingly, the ZSM-23 may be added directly, to the riser in which fluid catalytic cracking is being undertaken.

Although various amounts of the two sets of catalysts can be used, it is preferred that greater than zero (0) and less than 0.3 weight percent of the ZSM-23 is added to the total catalyst inventory for the invention process, per day.

The conversion of n-butene(s) to iso-butene over ZSM-23 at atmospheric pressure, high WHSV, and about 1000° F. occurs with no significant oligomerization to heavier molecules. The ZSM-23 isomerization of n-butene(s) is favored by low reactant partial pressure and high operating temperature in a cracker process. In such an embodiment, preferably the ZSM-23 containing catalyst is added to the cracker in short time intervals intermittently or alternatively continuously.

Referring to FIG. 2, there is shown a riser reactor 10 with a lower region 11 and conduit 13. The feed combines with stripped catalyst transferred directly from the lower region of catalyst bed 22 located within the stripping zone to the bottom of riser 10 through conduit 80 provided with flow control valve 81.

A heavy hydrocarbon feed, e.g., a gas oil and/or resid, can be introduced further up riser 10 in region 12 thereof through conduit 15 and combines with the ascending catalyst-hydrocarbon vapor suspension from lower region 11. The transfer of varying amounts, for example, of hot, regenerated zeolite Y from the regenerating zone through conduit 60 provided with flow control valve 61 permits regulation of the zeolite Y concentration in upper region 12 of the riser and assists in maintaining control of the temperature therein. Zeolite Y concentration can range from about 2 to about 50, preferably from about 5 to about 25, weight percent, the outlet temperature can range from about 900° to about 1150° F. and preferably from about 1000° to about 1050° F., the catalyst to heavy hydrocarbon feed ratio can range from about 3:1 to about 20:1 and preferably from about 4:1 to about 10:1 and the catalyst contact time can range from about 0.5 to about 30 seconds and preferably from about 1 to about 15 seconds. During passage of the suspension through the upper section of the riser, in this further illustration,conversion of the heavy hydrocarbon feed to lower boiling products occurs. The catalyst-hydrocarbon suspension ultimately passes to cyclone separator 14 which separates catalyst particles from gases, the former entering catalyst bed 22 via dipleg 20 and the latter entering plenum chamber 16 for transfer through conduit 18 to a downstream product separation facility (not shown). Vessel 26 which occupies an approximately central region of the stripping zone is provided with a source of stripping gas, e.g., steam, supplied through conduit 27 in the lower section thereof. The particles of greater average density, tend to gravitate toward and concentrate at the bottom of vessel 26 and, following stripping, to enter return conduit 28 provided with a source of low pressure steam 31 which blows smaller, less dense particles of zeolite which may have become entrained with the more dense particles back up into catalyst bed 22. The denser particles are then introduced to reactivation vessel 50' which, as previously indicated, can also operate as a stripper. Vessel 50' is supplied with hydrogen or a hydrogen-rich gas through line 51'. In accordance with the invention, the ZSM-23 (or ZSM-22 or ZSM-35) containing catalyst can be sized as the heaviest particles; as the heaviest particles the ZSM-23 could be easily separated from the fines recovered from main column bottoms; this is particularly desirable when the ZSM-23 (or ZSM-22 or ZSM-35) is introduced via the transfer line of the riser. Reactivation takes place under known conditions as stated above, the gaseous effluent together with some quantity of catalyst particles being conveyed through line 52 to cyclone separator 53 which separates the stream into gaseous material passing to plenum chamber 16 and catalyst which passes to catalyst bed 22 via dipleg 54. Reactivated catalyst particles, meanwhile, are conveyed through line 80 equipped with valve 81 to the bottom of riser 10 as previously indicated.

In the meanwhile, the ascending current of stripping gas and desorbed hydrocarbonaceous material from the stripper acts as a lift medium tending to carry lower density catalyst particles out of vessel 26 into an outer peripheral region 40 the lower section of which is provided with its own supply of stripping gas, again, e.g., steam, through conduit 41. Stripping gas and other gasiform material is separated from catalyst particles in cyclone separator 53, the former passing to plenum chamber 16 and the latter entering catalyst bed 22 via dipleg 54. Stripped, spent zeolite Y continues its downward flow movement and is withdrawn from the stripper through conduit 52 where it is conveyed to a regenerator (not shown) which is operated in a conventional or otherwise known fashion.

It is advantageous to utilize hydrogen recovered from the cracking operation in the hydrotreating of the gas oil/resid charge stock, especially where the latter contains fairly high quantities of metal contaminants and/or sulfur-containing material. Thus, hydrogen recovered from a gas plant operation is conveyed to a hydrotreating unit supplied with a gas oil/resid feed and operated in accordance with conventional or otherwise known conditions in the presence of suitable hydrotreating catalysts, e.g., cobalt and molybdenum oxides on alumina, nickel oxide, nickel thiomolybdat, tungsten and nickel sulfides and vanadium oxide. The hydrotreated gas/oil resid at elevated temperature is conveyed through conduit 15 to riser 10 as previously described.

EXAMPLES

In Table 1, the results of passing 1-butene (152 Torr); over HZSM-23 (alpha=19) (0.06013 G M S) under the conditions set forth are

TABLE I

| | | | |
|---|---|---|---|
| Press (Psig) | 3 | 5 | 8 |
| Temp (oC) | 500 | 501 | 501 |
| Flow (CC/Min) | 100 | 150 | 200 |
| WHSV | — | — | — |
| | WEIGHT PERCENT IN PRODUCT STREAM | | |
| C10 | 0.238 | 0.177 | 0.146 |
| C20 | 0.031 | 0.022 | 0.018 |
| C2= | 0.281 | 0.199 | 0.158 |
| C30 | 0.014 | 0.008 | 0.006 |
| C3= | 1.351 | 0.971 | 0.775 |
| I-C40 | 0.158 | 0.110 | 0.086 |
| N-C40 | 0.561 | 0.461 | 0.408 |
| 1 − C4 = | 16.516 | 17.915 | 19.113 |
| I − C4 = | 34.474 | 30.874 | 27.636 |
| TR − 2 − C4 = | 26.935 | 28.726 | 30.140 |
| CIS − 2 − C4 = | 18.518 | 19.904 | 21.043 |
| N-C50 | 0.000 | 0.000 | 0.000 |
| 3M − 1 − C4 = | 0.000 | 0.000 | 0.000 |
| 1 − C5 = | 0.000 | 0.000 | 0.000 |
| TR − 2 − C5 = | 0.119 | 0.076 | 0.057 |
| CIS − 2 − C5 = | 0.044 | 0.025 | 0.000 |
| TERT − C5 = | 0.654 | 0.476 | 0.384 |
| C6= | 0.079 | 0.055 | 0.029 |
| C7+ | 0.026 | 0.000 | 0.000 |
| Cl-C5 PARFNS | 1.002 | 0.778 | 0.664 |
| C2= | 0.281 | 0.199 | 0.158 |
| C3= | 1.351 | 0.971 | 0.775 |
| C4= | 96.443 | 97.419 | 97.932 |
| C5= | 0.817 | 0.577 | 0.441 |
| C6= | 0.079 | 0.055 | 0.029 |
| C7+ | 0.026 | 0.000 | 0.000 |
| Conv. of N − C4 = | 38.031 | 33.455 | 29.704 |
| I − C4 = | 34.474 | 30.874 | 27.636 |
| Sel. to I − C4 = | 90.647 | 92.285 | 93.039 |

The foregoing results show surprisingly high and selective conversion of n-butene to iso-butene over ZSM-23 at atmospheric pressure, high WHSV, and about 1000° F. These results appear to suggest that the ZSM-23 pore structure is such that no significant oligomerization to heavier molecules can occur under the operating conditions used in this invention. This makes ZSM-23 catalyst a highly selective light olefin isomerization catalyst. Isomerization is favored by low reactant partial pressure and high operating temperature in the cracker.

In implementing the invention, it would be preferred to add the ZSM-23 catalyst to the cracker in short time intervals or continuously. The ZSM-23 catalyst can be added to the FCC unit at any location in the riser, transfer line, or reactor cyclones. Presently, it is contemplated that, preferably less than 0.1% of ZSM-23 is added to the cracker catalyst inventory per day. The process is preferably undertaken in an FCC unit. However, the process may be undertaken in FCC, TCC, coker, or thermal cracker (e.g. steam cracker for weight HC's) modes.

What is claimed is:

1. A fluid catalytic cracking process for upgrading $C_9$+ aromatic containing feeds to produce gasoline, distillate, and $C_4$ olefins, wherein the $C_4$ olefins include 1-butene, cis-2-butene, trans-2-butene, which process is undertaken in a fluid catalytic cracking unit which includes a riser, a stripping unit and a regenerator, wherein the process comprises:

a) cracking a $C_9$+ containing feed, selected from the group consisting of gas oil, resid and admixtures thereof, in a riser in the presence of a first catalyst component, under fluid catalytic cracking conditions, wherein the first catalyst component comprises an amorphous cracking catalyst, a large pore crystalline cracking catalyst or admixtures thereof, to provide gasoline boiling range components, and an amount of $C_4$ olefins comprising said 1-butene, cis-2-butene, trans-2-butene, and admixtures thereof in a first product mixture;

wherein the fluid catalytic cracking conditions include a riser top temperature within the range of from about 950° to about 1150° F., a catalyst to feed ratio from about 3:1 to about 10:1, and a catalyst contact time from about 0.5 to about 10 seconds;

b) contacting said first product mixture with a second catalyst component which comprises ZSM-23, under conditions effective to increase isomerization, with no significant oligomerization to heavier molecules, of at least one of $C_4$ olefins selected from the group consisting of 1-butene, cis-2-butene, trans-2-butene, and admixtures thereof to 2-methylpropene, with no significant oligomerization to heavier molecules, and recovering a second product mixture which contains amounts of 2-methylpropene greater than that in the first effluent, wherein the conditions of the vapor phase catalytic isomerization of the 1-butene, cis-2-butene, and trans-2-butene to the isobutylene include a temperature within the range of from about 950° to about 1150° F., a catalyst to feed ratio of from about 3:1 to about 10:1, and a catalyst contact time from about 0.5 to about 10 seconds.

2. The process of claim 1, wherein there is a difference between one or more physical characteristics of the first catalyst component and the second catalyst component effective to permit particles of first catalyst component to be separated from particles of second catalyst component.

3. The process of claim 2, which further includes a) separating particles of spent first catalyst component from particles of second catalyst component in the stripping unit;

b) stripping the separated particles of first catalyst component;

c) conveying stripped, spent first catalyst component to the regenerator, the catalyst undergoing regeneration therein;

d) conveying regenerated first catalyst component to the riser;

e) conveying stripped or non-stripped separated particles of second catalyst component to a reactivation zone, the catalyst undergoing reactivation therein; and, f) conveying reactivated second catalyst component to the riser.

4. The process of claim 1, wherein the ZSM-23, is added to the first effluent intermittently.

5. The process of claim 1, wherein the ZSM-23, is added to the first effluent continuously.

6. The process of claim 3, wherein the ZSM-23, is added to the first effluent intermittently.

7. The process of claim 3, wherein the ZSM-23, is added to the first effluent continuously.

8. The process of claim 1, which further includes increasing the octane value of the gasoline by adding ZSM-5 to the riser.

9. The process of claim 4, which further includes increasing the octane value of the gasoline by adding ZSM-5 to the riser.

10. The process of claim 5, which further includes increasing the octane value of the gasoline by adding ZSM-5 to the riser.

11. The process of claim 6, which further includes increasing the octane value of the gasoline by adding ZSM-5 to the riser.

12. The process of claim 7, which further includes increasing the octane value of the gasoline by adding ZSM-5 to the riser.

13. The process of claim 1, wherein the ZSM-23 is provided in an amount sufficient to achieve a level of 0.01 to 1.0 weight percent of the total catalyst inventory.

14. The process of claim 1, wherein cracking in a) further produces n—$C_5$ olefins, wherein at least a portion of said n—$C_5$ olefins is isomerized to i—$C_5$ olefin, in b).

15. The process of claim 14, wherein the ZSM-23 is provided in an amount sufficient to achieve a level of 0.01 to 1.0 weight percent of the total catalyst inventory.

16. The process of claim 1, wherein the second catalyst component is added to said riser via a transfer line.

* * * * *